US007862380B1

(12) United States Patent
Wang

(10) Patent No.: US 7,862,380 B1
(45) Date of Patent: Jan. 4, 2011

(54) WATERPROOF STRUCTURE FOR TRANSFORM PLUG OF SOCKET

(75) Inventor: Lien-Sheng Wang, Hsinchu County (TW)

(73) Assignee: Ting Shen Industrial Co., Ltd., Hsinchu (TW)

( * ) Notice: Subject to any disclaimer, the term of this patent is extended or adjusted under 35 U.S.C. 154(b) by 0 days.

(21) Appl. No.: 12/659,681

(22) Filed: Mar. 17, 2010

(51) Int. Cl.
*H01R 13/68* (2006.01)

(52) U.S. Cl. ..... 439/620.22; 320/111; 439/694; 200/61.02

(58) Field of Classification Search ..... 439/76.1, 439/620.22, 694, 521; 320/111
See application file for complete search history.

(56) References Cited

U.S. PATENT DOCUMENTS 4,227,228 A * 10/1980 Cheng ..... 361/104
5,160,879 A * 11/1992 Tortola et al. ..... 320/111
5,777,868 A * 7/1998 Gibboney, Jr. ..... 363/146
5,973,948 A * 10/1999 Hahn et al. ..... 363/146
6,297,982 B1 * 10/2001 Wu ..... 363/146
6,454,612 B1 * 9/2002 Wang ..... 439/694
6,471,365 B2 * 10/2002 Wang et al. ..... 362/84
6,644,984 B2 * 11/2003 Vista et al. ..... 439/76.1
7,002,808 B2 * 2/2006 Lim et al. ..... 361/752
7,005,591 B1 * 2/2006 Fleury ..... 200/51 R
7,101,226 B1 * 9/2006 Gilliland ..... 439/620.01
2002/0154528 A1 * 10/2002 Ravid ..... 363/146
2005/0189911 A1 * 9/2005 Cheng ..... 320/111
2009/0284221 A1 * 11/2009 Liao ..... 320/111
2009/0289596 A1 * 11/2009 McGinley et al. ..... 320/111
2009/0309542 A1 * 12/2009 Hung et al. ..... 320/111
2010/0144194 A1 * 6/2010 Umei et al. ..... 439/521

* cited by examiner

*Primary Examiner*—Neil Abrams
*Assistant Examiner*—Harshad C Patel
(74) *Attorney, Agent, or Firm*—Bacon & Thomas, PLLC

(57) ABSTRACT

A waterproof structure for a transform plug of a socket includes a housing having a front receiving portion and a rear receiving portion spaced in a hollow exterior thereof by using a first and the second partition to receive a conducting pieces and a transforming unit respectively, and a waterproof layer is formed between outer rims of a back cover, a rear cover, and the housing to prevent water from permeation. In addition, a photo resistor and a transparent portion of the back cover are used to conduct the power source to a light string automatically based on lights, thus flashing light freely.

8 Claims, 8 Drawing Sheets

WATERPROOF STRUCTURE FOR TRANSFORM PLUG OF SOCKET

BACKGROUND OF THE INVENTION

1. Field of the Invention

The present invention relates to a waterproof structure for a transform plug of a socket.

2. Description of the Prior

U.S. Pat. No. 7,140,920 discloses that an electric plug includes: a housing; a mounting seat mounted in the housing and having two opposite side walls, a U-shaped transverse wall interconnecting the side walls and defining a resistor-receiving recess, and a partition wall cooperating with the side walls to define two opposite fuse-receiving grooves, the mounting seat further having two wings that cooperate with the side walls to define two opposite prong-receiving grooves; a pair of prongs extending through the prong-receiving grooves and provided with protrusions that extend through the side walls and into the fuse-receiving grooves; a voltage-limiting component mounted in the resistor-receiving recess and having a pair of conductive clamping members extending into the fuse-receiving grooves, respectively; and a pair of fuses clamped by the clamping members and extending into the fuse-receiving grooves to contact the prongs.

However, the voltage-limiting component is mounted in the plug and the is located at a predetermined room the same as the conductive clamping members that can not obtain a waterproof effect, and electric parts of the voltage-limiting component can not be received. Besides, a light string is powered on after the power source is turn on or the plug is inserted to a socket that it can not be powered on automatically.

The present invention has arisen to mitigate and/or obviate the afore-described disadvantages.

SUMMARY OF THE INVENTION

The primary object of the present invention is to provide a waterproof structure for a transform plug of a socket includes a housing having a front receiving portion and a rear receiving portion spaced in a hollow exterior thereof by using a first and the second partition to receive a conducting pieces and a transforming unit respectively, and a waterproof layer is formed between outer rims of a back cover, a rear cover, and the housing to prevent water from permeation.

Another object of the present invention is to provide a waterproof structure for a transform plug of a socket that the photo resistor and the transparent portion of the back cover are used to conduct the power source to the light string automatically based on lights, thus flashing light freely.

A waterproof structure for a transform plug of a socket according to the present invention comprises a housing, two conducting pieces, a transforming unit, a rear cover, a back cover, and a waterproof layer, wherein the housing is hollow and includes a first partition defined between two sides of a front end thereof, a front receiving portion and a rear receiving portion spaced in a hollow exterior thereof respectively, the front receiving portion is used to receive the conducting piece between which a second partition is vertically connected to the first partition and a front end of the housing to divide the front receiving portion into two closed rooms, the rear receiving portion is used to receive the transforming unit, and includes a retaining groove disposed on a rear end of the housing to communicate with the rear receiving portion and to receive the rear cover and covered by the back cover;

the conducting pieces are integrally fixed on the front end of the housing, and each includes a first connecting extension and a second connecting extension, the first connecting extension is located at the closed room of the front receiving portion and matches with the second partition to form a hole to insert another power plug, and the second connecting extensions insert through the first partition so that projected ends of the connecting extensions extend into the rear receiving portion to electrically connect with the transforming unit;

the transforming unit is used to transform an alternating current into a direct current and comprised of a circuit board, a plurality of electronic parts, two first guiding potions, two second guiding portions, the circuit board is disposed on a top rim of the rear receiving portion, and the first guiding potions are fixed on a front end of the circuit board in response to the conducting pieces to electrically connect with one ends of the connecting extensions, the second guiding portions are arranged on a rear end of the circuit board to electrically connect with the rear cover 40;

the rear cover is mounted in the retaining groove of the housing, and includes two electric coupling portions fixed on an inner side thereof in response to the transforming unit to electrically connect with the second guiding portions, and includes two wire coupling portions extending from an inner rim of a front end thereof to electrically connect with a wire of a light string;

the back cover is in response to an outer rim of the housing to cover the front and the rear receiving portions of the housing, and includes two orifices formed on one end thereof in response to the conducting pieces, and includes a plurality of recesses disposed thereon in response to the first and the second partitions to retain with the peripheral projections of the first and the second partitions to prevent water from permeating into the front receiving portion;

the waterproof layer is formed between outer rims of the back cover, the rear cover, and the housing to seal the outer rims of the back cover, the rear cover, and the housing.

DETAILED DESCRIPTION OF THE PREFERRED EMBODIMENTS

Figure 1:
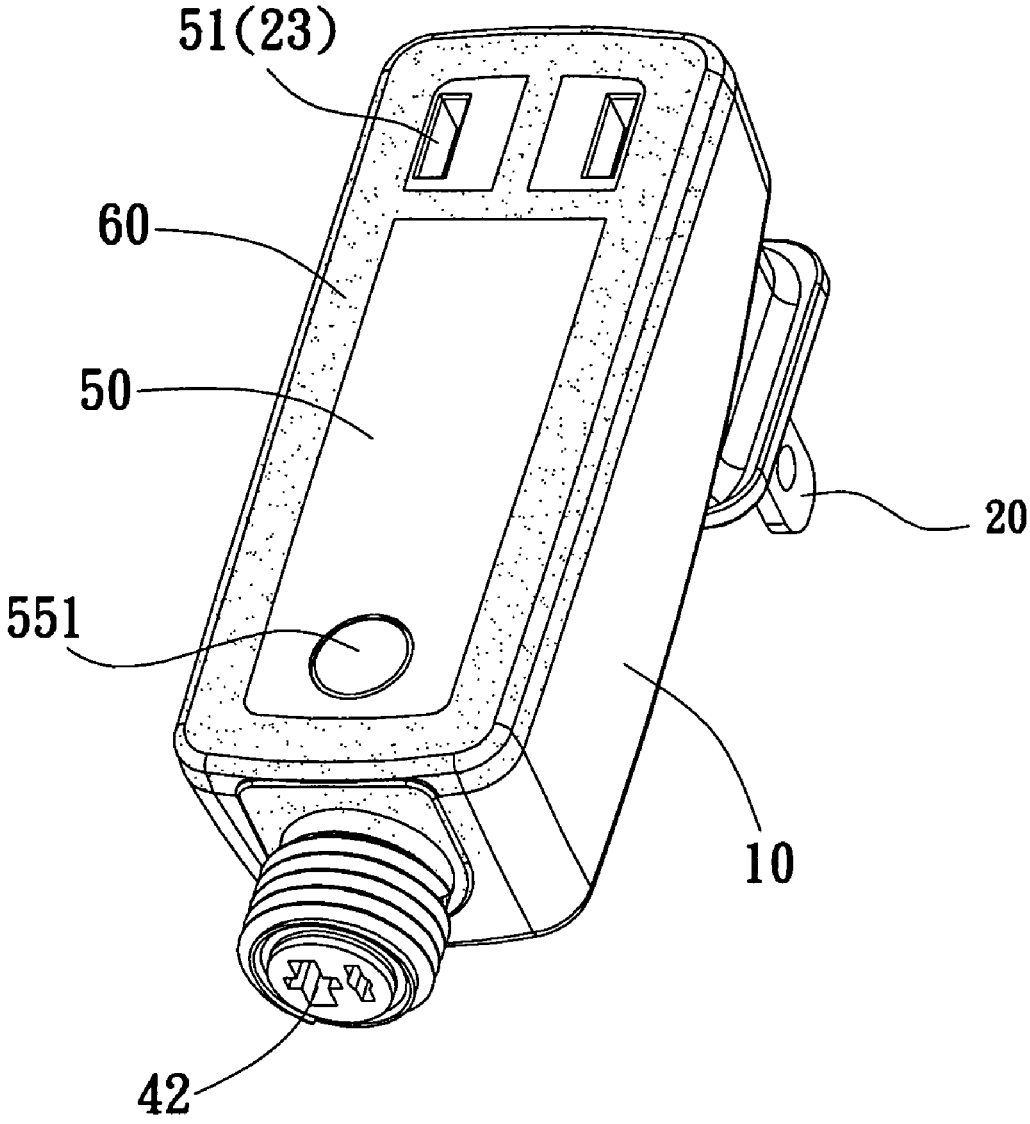
FIG. 1 is a perspective view showing the assembly of a waterproof structure for a transform plug of a socket according to the present invention.

The present invention will be clearer from the following description when viewed together with the accompanying drawings, which show, for purpose of illustrations only, the preferred embodiment in accordance with the present invention.

Referring to FIGS. 1-8, a waterproof structure for a transform plug of a socket according to the present invention comprises a housing 10, two conducting pieces 20, a transforming unit 30, a rear cover 40, a back cover 50, and a waterproof layer 60.

The housing 10 is hollow and includes a first partition 11 defined between two sides of a front end thereof, and a front receiving portion 12 and a rear receiving portion 13 spaced in a hollow exterior thereof respectively. The front receiving portion 12 is used to receive the conducting piece 20 between which a second partition 14 is vertically connected to the first partition 11 and a front end of the housing 10 to divide the front receiving portion 12 into two closed rooms. The rear receiving portion 13 is used to receive the transforming unit 30, and includes a retaining groove 15 disposed on a rear end of the housing 10 to communicate with the rear receiving portion 13 and to receive the rear cover 40, and covered by the back cover 50. The first partition 11 and the second partition 14 include two peripheral projections 16 mounted thereon respectively to retain the back cover 50 onto an outer rim of the housing 10.

The conducting pieces 20 are formed in an irregular rectangle shape and made of metal material, before the housing 10 is injection molded, the conducting pieces 20 are placed in a mold and are in response to the front receiving portion 12, and after the housing 10 is injection molded, the conducting pieces 20 are integrally fixed on the front end of the housing 10, and each includes a first connecting extension 21 and a second connecting extension 22, the first connecting extension 21 is located at the closed room of the front receiving portion 12 and matches with the second partition 14 to form a hole 23 to insert another power plug so that when rains permeates, current conducts through the conducting piece 20 but not generate short circuit. Furthermore, the second connecting extensions 22 insert through the first partition 11 so that projected ends of the connecting extensions 22 extend into the rear receiving portion 13 to electrically connect with the transforming unit 30.

Figure 6:
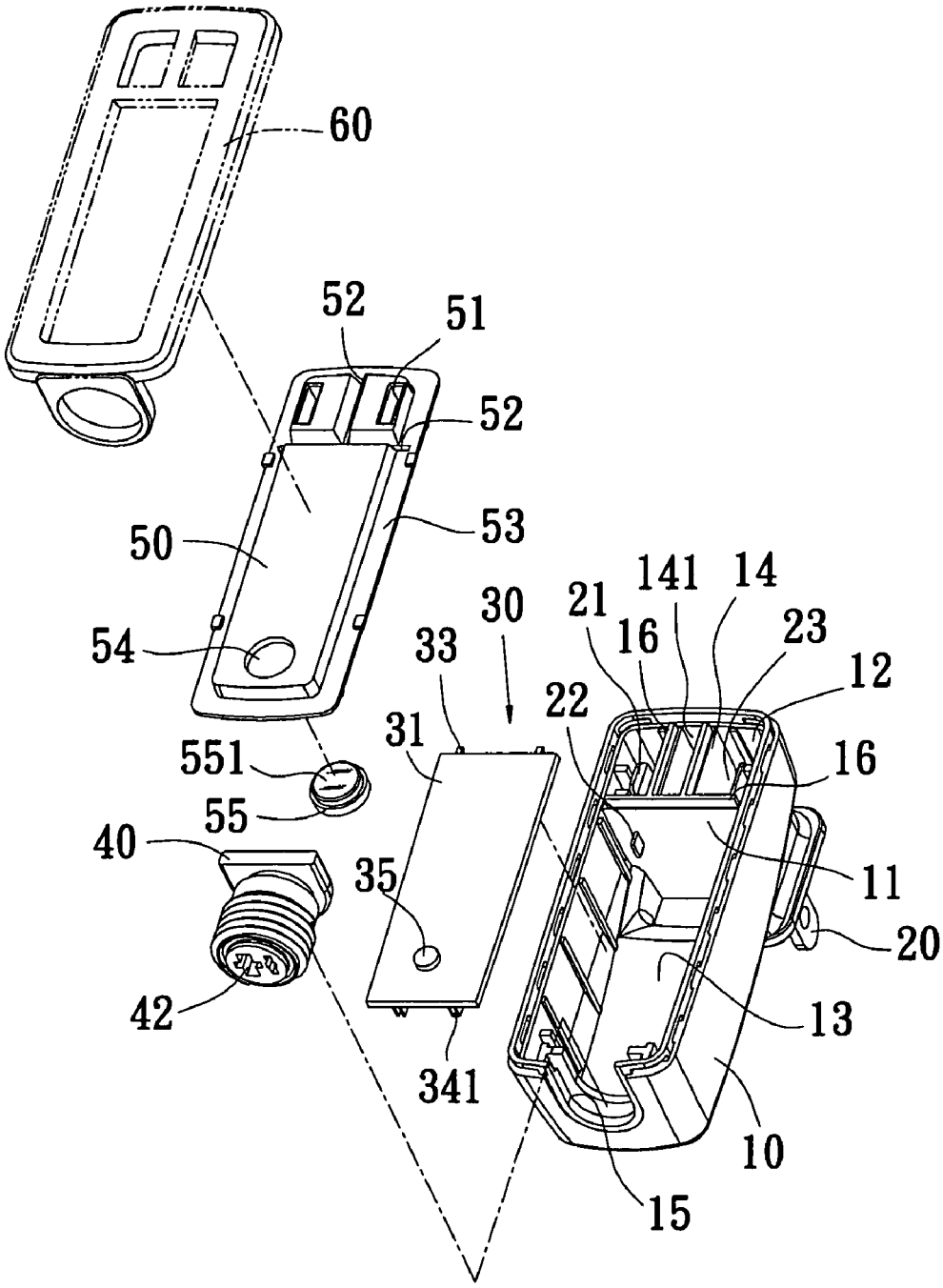
FIG. 6 is a perspective view showing the exploded components of another waterproof structure for the transform plug of the socket.
Figure 7:
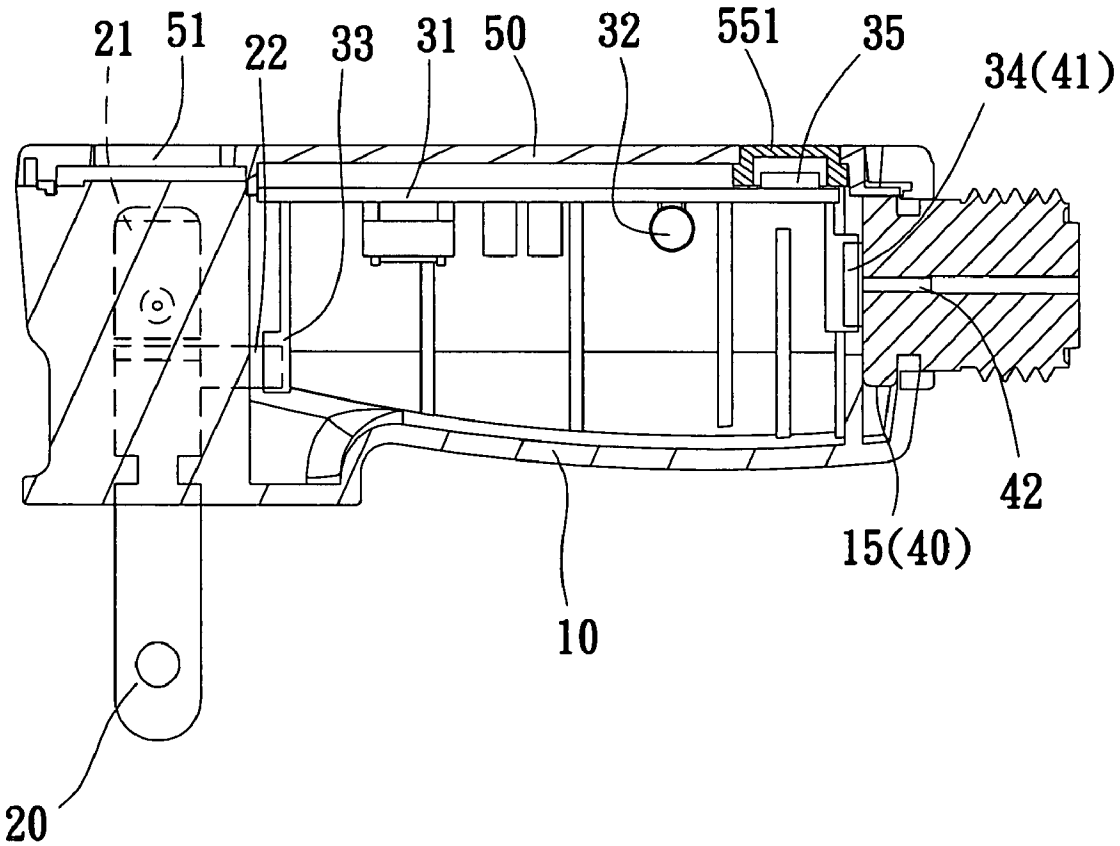
FIG. 7 is a cross sectional view showing the assembly of the waterproof structure for the transform plug of the socket according to the present invention.
Figure 8:
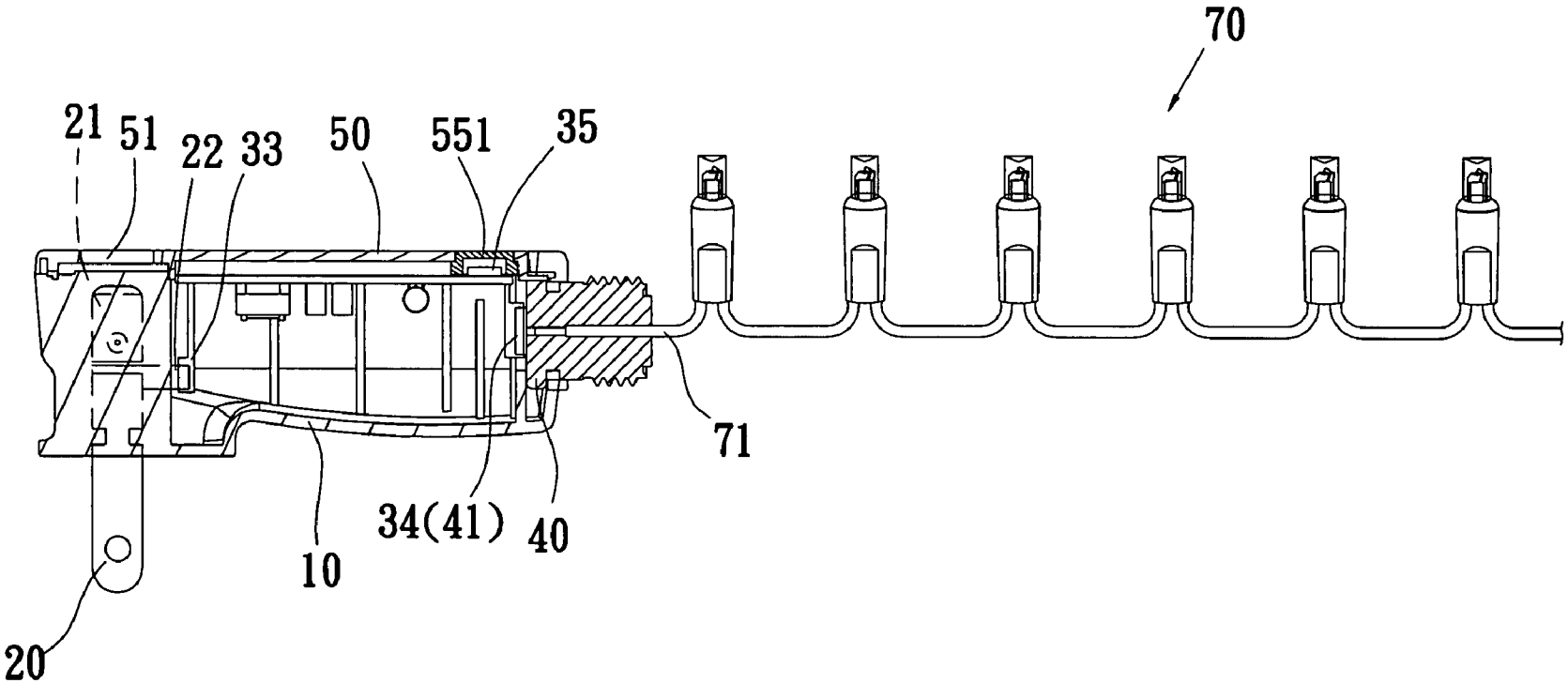
FIG. 8 is a cross sectional view showing the operation of the waterproof structure for the transform plug of the socket according to the present invention.

Referring to FIG. 6, a thickness of the second partition 14 is increased, and the second partition 14 includes a cavity 141 formed on a central position of the second partition 14 to enhance an isolating effect between two sides of the front receiving portion 12 and stabilize a structure of the hole 23 to increase stability of a conducting piece set of the another plug.

The transforming unit 30 is assembled in the rear receiving portion 13 and comprised of a circuit board 31, a plurality of electronic parts 32, two first guiding potions 33, two second guiding portions 34, and a photo resistor 35. The circuit board 31 is disposed on a top rim of the rear receiving portion 13, the electronic parts 32 are mounted onto the circuit board 31 to transform an alternating current into a direct current, and the first guiding potions 33 are fixed on a front end of the circuit board 31 in response to the conducting pieces 20 to electrically connect with one ends of the connecting extensions 22. The second guiding portions 34 are arranged on a rear end of the circuit board 31, and each includes a recessed retaining portion 341 secured on an outer side thereof to electrically connect with a projected end portion of the rear cover 40, the photo resistor 35 is disposed on an outer rim of the circuit board 31 in response to the back cover 50.

The rear cover 40 is mounted in the retaining groove 15 of the housing 10, and includes two electric coupling portions 41 fixed on an inner side thereof in response to the transforming unit 30 to electrically connect with the second guiding portions 34, and includes two wire coupling portions 42 extending from an inner rim of a front end thereof to electrically connect with a wire 71 of a light string 70.

The back cover 50 is formed in a plate shape in response to the outer rim of the housing 10 to cover the front and the rear receiving portions 12, 13 of the housing 10, and includes two orifices 51 formed on one end thereof in response to the conducting pieces 20, and includes a plurality of recesses 52 disposed thereon in response to the first and the second partitions 11, 14 to retain with the peripheral projections 16 of the first and the second partitions 11, 14 to prevent water from permeating into the front receiving portion 12. The back cover 50 also includes a gluing portion 53 arranged around an outer rim thereof to attach with the waterproof layer 60, and includes a bore 54 disposed on a suitable position thereof in response to the photo resistor 35, and the bore 54 includes a cap 55 with a transparent portion 551 mounted thereon. The photo resistor 35 senses light from the transparent portion 551 to be used as a plug to conduct power source automatically, controlling the light string 70 to flash.

Figure 2:
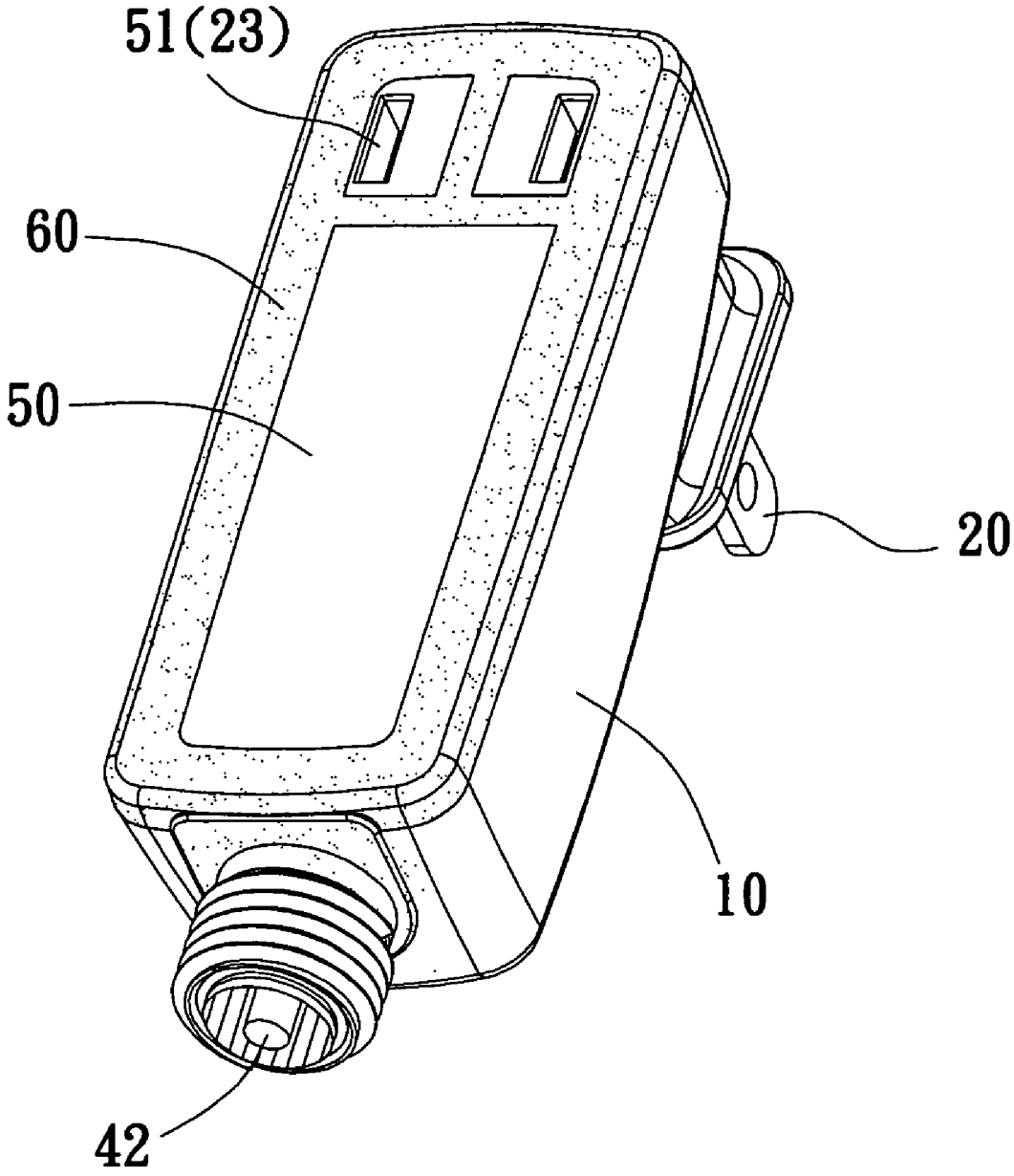
FIG. 2 is a perspective view showing the assembly of another waterproof structure for the transform plug of the socket according to the present invention.
Figure 3:
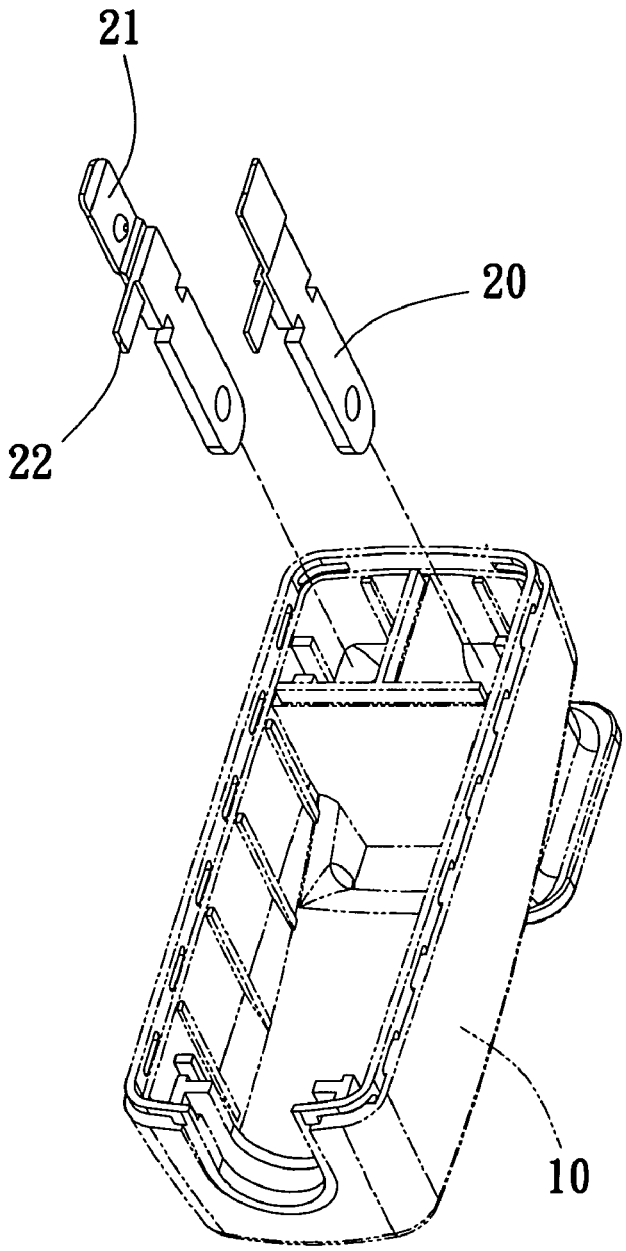
FIG. 3 is a perspective view showing a conducting pieces being integrally fixed to a housing.
Figure 4:
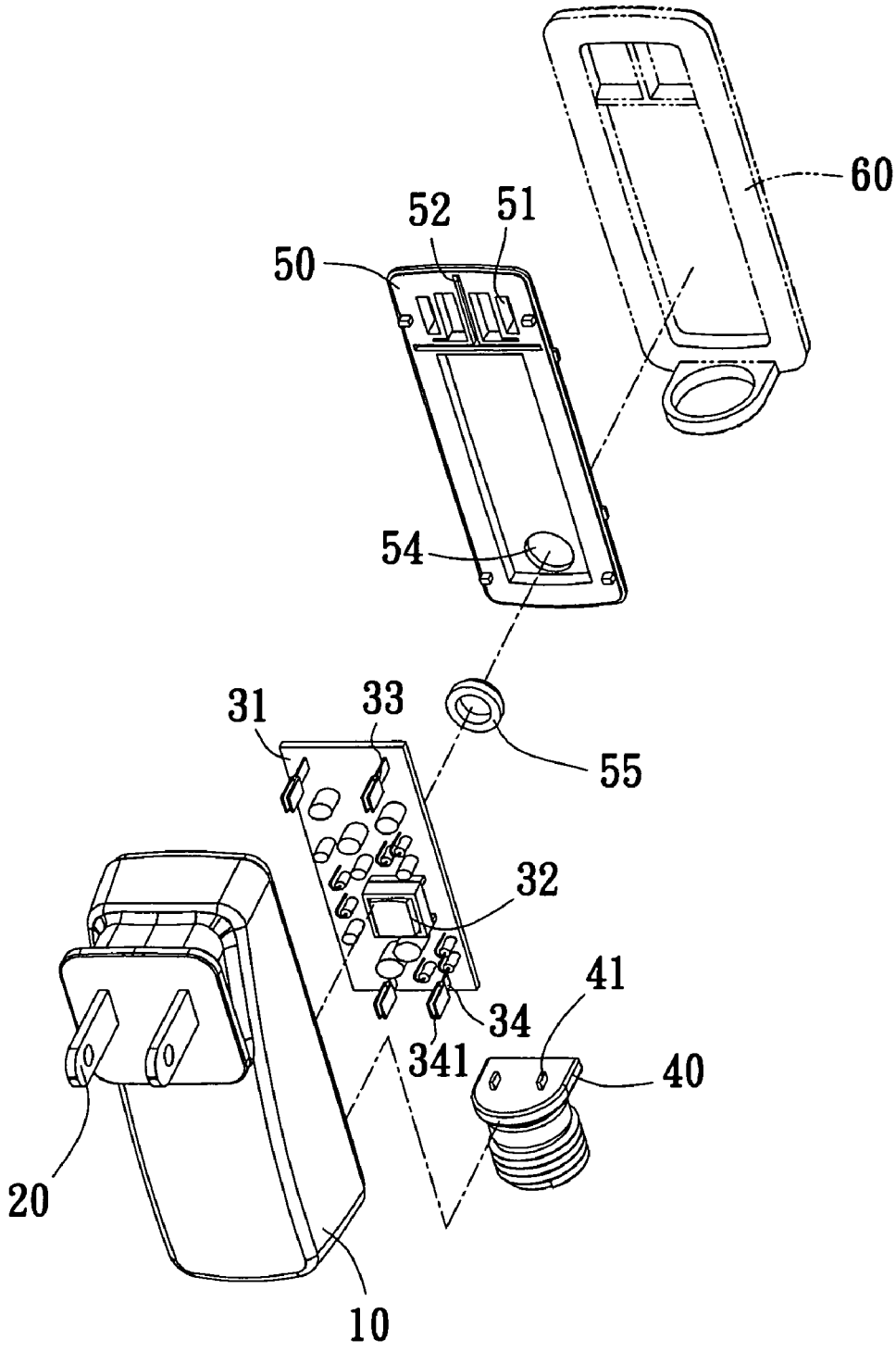
FIG. 4 is a perspective view showing the exploded components of the waterproof structure for the transform plug of the socket according to the present invention.
Figure 5:
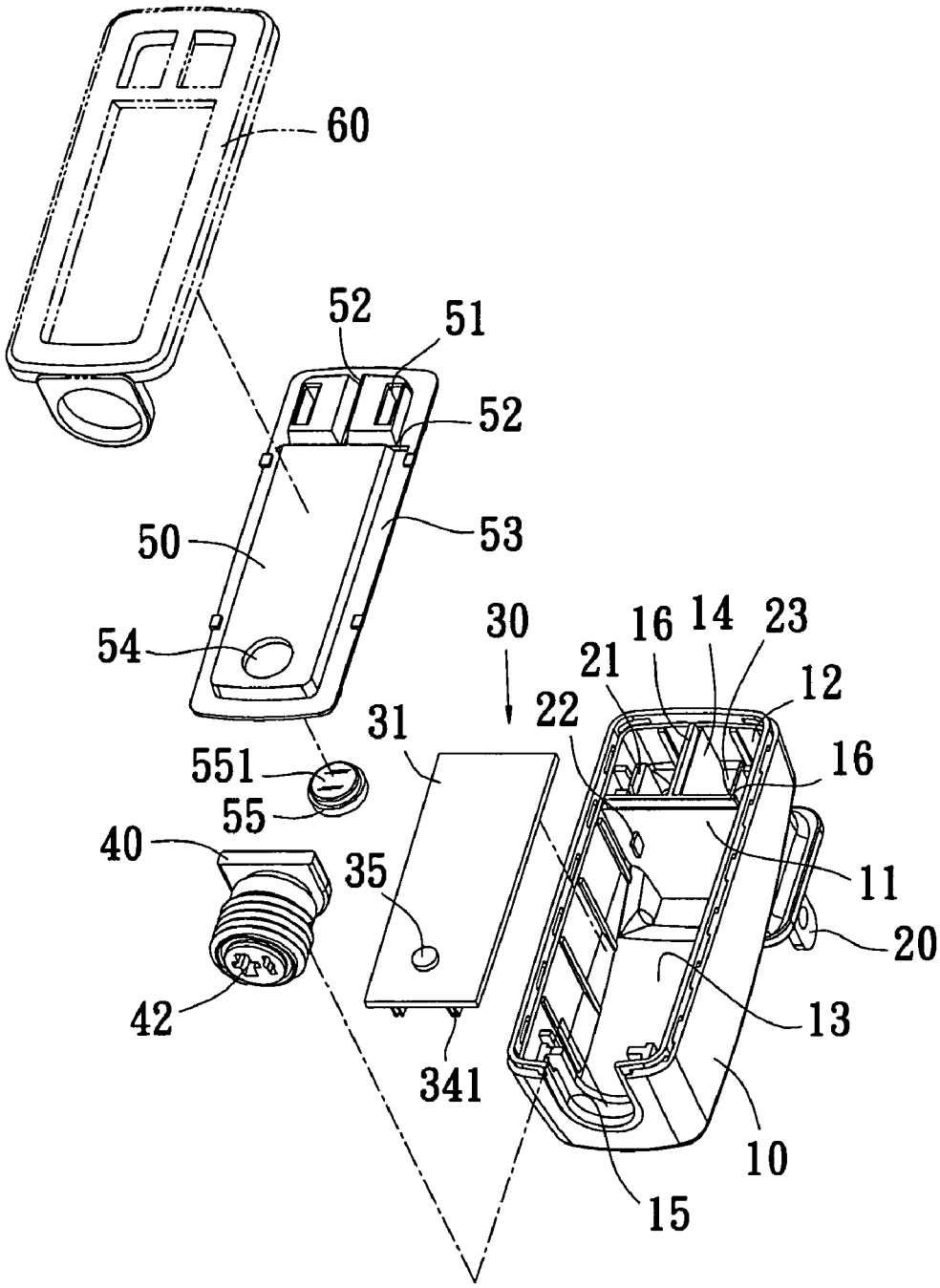
FIG. 5 is another perspective view showing the exploded components of the waterproof structure for the transform plug of the socket according to the present invention.

As shown in FIG. 2, the photo resistor 35 and the cap 55 can not be provided in the waterproof structure of the present invention, and the circuit board 31 of the transforming unit 30 includes a circuit program installed thereon to control the light string 70 to flash. Likewise, the wire coupling portion 42 of the rear cover 40 can be provided a single aperture thereon to insert a terminal plug (not shown).

The waterproof layer 60 is formed between outer rims of the back cover 50, the rear cover 40, and the housing 10 to seal the outer rims of the back cover 50, the rear cover 40, and the housing 10. The waterproof layer 60 is made of thermoplastic material, and the thermoplastic material is selected from polypropylene, polyethylene, polystyrene, and polycarbonate. Also, the waterproof layer 60 is made of artificial rubber, and the artificial rubber is acrylonitrile-butadene-styrene. The method for forming the waterproof layer 60 includes placing an assembled plug into a mold, and injection molding the waterproof layer 60 between the outer rims of the back cover 50, the rear cover 40, and the housing 10.

Thereby, the housing 10 includes the front receiving portion 12 and the rear receiving portion 13 spaced in the hollow exterior thereof by using the first and the second partitions 11, 14 to receive the conducting pieces 20 and the transforming unit 30 respectively, and the waterproof layer 60 is formed between outer rims of the back cover 50, the rear cover 40, and the housing 10 to prevent water from permeation. In addition, the photo resistor 35 and the transparent portion 551 of the back cover 50 are used to conduct the power source to the light string 70 automatically based on lights, thus flashing light freely.

While we have shown and described various embodiments in accordance with the present invention, it is clear to those skilled in the art that further embodiments may be made without departing from the scope of the present invention.

What is claimed is:

1. A waterproof structure for a transform plug of a socket comprising:

a housing, two conducting pieces, a transforming unit, a rear cover, a back cover, and a waterproof layer, wherein the housing is hollow and includes a first partition defined between two sides of a front end thereof, a front receiving portion and a rear receiving portion spaced in a hollow exterior thereof respectively, the front receiving portion is used to receive the conducting piece between which a second partition is vertically connected to the first partition and a front end of the housing to divide the front receiving portion into two closed rooms, the rear receiving portion is used to receive the transforming unit, and includes a retaining groove disposed on a rear end of the housing to communicate with the rear receiving portion and to receive the rear cover and covered by the back cover;

the conducting pieces are integrally fixed on the front end of the housing, and each includes a first connecting extension and a second connecting extension, the first connecting extension is located at the closed room of the front receiving portion and matches with the second partition to form a hole to insert another power plug, and the second connecting extensions insert through the first partition so that projected ends of the connecting extensions extend into the rear receiving portion to electrically connect with the transforming unit;

the transforming unit is used to transform an alternating current into a direct current and comprised of a circuit board, a plurality of electronic parts, two first guiding potions, two second guiding portions, the circuit board is disposed on a top rim of the rear receiving portion, and the first guiding potions are fixed on a front end of the circuit board in response to the conducting pieces to electrically connect with one ends of the connecting extensions, the second guiding portions are arranged on a rear end of the circuit board to electrically connect with the rear cover;

the rear cover is mounted in the retaining groove of the housing, and includes two electric coupling portions fixed on an inner side thereof in response to the transforming unit to electrically connect with the second guiding portions, and includes two wire coupling portions extending from an inner rim of a front end thereof to electrically connect with a wire of a light string;

the back cover is in response to an outer rim of the housing to cover the front and the rear receiving portions of the housing, and includes two orifices formed on one end thereof in response to the conducting pieces, and includes a plurality of recesses disposed thereon in response to the first and the second partitions to retain with peripheral projections of the first and the second partitions to prevent water from permeating into the front receiving portion;

the waterproof layer is formed between outer rims of the back cover, the rear cover, and the housing to seal the outer rims of the back cover, the rear cover, and the housing.

2. The waterproof structure for the transform plug of the socket as claimed in claim 1, wherein the first partition and the second partition include two peripheral projections mounted thereon respectively to retain the back cover onto an outer rim of the housing.

3. The waterproof structure for the transform plug of the socket as claimed in claim 1, wherein the second partition includes a cavity formed on a central position of the second partition to enhance an isolating effect between two sides of the front receiving portion and stabilize a structure of the hole.

4. The waterproof structure for the transform plug of the socket as claimed in claim 2, wherein the second partition includes a cavity formed on a central position of the second partition to enhance an isolating effect between two sides of the front receiving portion and stabilize a structure of the hole.

5. The waterproof structure for the transform plug of the socket as claimed in claim 1, wherein a method for forming the waterproof layer includes placing an assembled plug into a mold, and injection molding the waterproof layer between the outer rims of the back cover, the rear cover, and the housing, and the waterproof layer is made of thermoplastic material.

6. The waterproof structure for the transform plug of the socket as claimed in claim 5, wherein the thermoplastic material is selected from polypropylene, polyethylene, polystyrene, and polycarbonate.

7. The waterproof structure for the transform plug of the socket as claimed in claim 1, wherein a method for forming the waterproof layer includes placing an assembled plug into a mold, and injection molding the waterproof layer between the outer rims of the back cover, the rear cover, and the housing, and the waterproof layer is made of artificial rubber.

8. The waterproof structure for the transform plug of the socket as claimed in claim 7, wherein the artificial rubber is acrylonitrile-butadene-styrene.

* * * * *